US006075466A

United States Patent [19]

Cohen et al.

[11] Patent Number: 6,075,466

[45] **Date of Patent: *Jun. 13, 2000**

[54] PASSIVE ROAD SENSOR FOR AUTOMATIC MONITORING AND METHOD THEREOF

[75] Inventors: Simon S. Cohen, Haifa; Oded Kafri, Beer-Sheva, both of Israel

[73] Assignee: Tracon Systems Ltd., Nesher, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 08/684,944

[22] Filed: Jul. 19, 1996

[51] Int. Cl.[7] ..... G08G 1/01

[52] U.S. Cl. ..... 340/933; 340/937; 340/942

[58] Field of Search ..... 340/933, 936, 340/942, 941, 937, 943; 364/436, 438; 348/148, 149; 701/117, 119

[56] References Cited

U.S. PATENT DOCUMENTS

| | | | |
|---|---|---|---|
| 4,360,795 | 11/1982 | Hoff | 340/933 |
| 5,008,666 | 4/1991 | Gebert et al. | 340/936 |
| 5,041,828 | 8/1991 | Loeven | 340/937 |
| 5,057,831 | 10/1991 | Strang et al. | 340/941 |
| 5,066,950 | 11/1991 | Schweitzer | 340/937 |
| 5,204,675 | 4/1993 | Sekine | 340/933 |
| 5,239,148 | 8/1993 | Reed | 340/666 |
| 5,373,487 | 12/1994 | Crawford et al. | 367/149 |
| 5,491,475 | 2/1996 | Rouse et al. | 340/933 |
| 5,512,891 | 4/1996 | Kang | 340/941 |
| 5,554,907 | 9/1996 | Dixon | 310/339 |
| 5,668,540 | 9/1997 | Bailleul et al. | 340/933 |

FOREIGN PATENT DOCUMENTS

| | | | |
|---|---|---|---|
| 2 675 610 A1 | 10/1992 | France | G08B 1/01 |
| 405314388 | 11/1993 | Japan . | |
| 89/06413 | 7/1989 | WIPO | G08G 1/02 |

OTHER PUBLICATIONS

Mizumachi, K., "Automatic License Plate Identification Number," *Proceedings 1987 Carnahan conference on Security Technology,* pp. 49–54 (Jul. 15–17, 1987).

*Primary Examiner*—Jeff Hofsass
*Assistant Examiner*—Julie Lieu
*Attorney, Agent, or Firm*—Hamilton, Brook, Smith & Reynolds, P.C.

[57] ABSTRACT

An automatic traffic monitoring system for enforcing traffic laws and regulations and for general purpose traffic monitoring includes a novel passive road sensor that accurately detects the kinematics of moving vehicles. A passive road sensor includes a detector protected in an enclosure, which is embedded in a road opening, is in a continuous listening mode. When the wheels of a passing vehicle come in contact with either the road opening, the enclosure, or both, the resulting mechanical impact generates a disturbance that triggers the detector. A processor unit of the automatic traffic monitoring system records the signal sensed by the detector and analyzes its temporal characteristics to determine the precise time of impact.

18 Claims, 7 Drawing Sheets

PASSIVE ROAD SENSOR FOR AUTOMATIC MONITORING AND METHOD THEREOF

BACKGROUND

In the modern traffic theater, it is often required to monitor and enforce traffic laws and regulations, and/or control access to restricted areas and localities. For example, monitoring vehicle's speed is of utmost importance for a safe traffic arena.

One common method for enforcing the law on highways and byways is to employ police officers who monitor traffic manually and issue citations to violators when appropriate. Police officers make use of certain electronic devices, such as a laser gun, to determine vehicles speed. Their task is often limited to enforcing speed limit and only seldom are they engaged in monitoring and enforcing other traffic laws, such as overtaking past a solid divide line, ignoring "stop" and "yield" signs, and crossing an intersection in red traffic light. Moreover, this manual method is usually employed only during daylight and is inherently ineffective due to human limitations. Many violators may escape while the officer is engaged in issuing one citation. Also, the presence of police may be detected by vehicle operators who momentarily obey the law.

Apart from enforcement by means of a close human intervention, there also exist certain semi-automatic systems, such as the one involving a camera that monitors vehicles crossing an intersection in red traffic lights. In this system a camera is activated by a magnetic sensor embedded inside the intersection. This sensor is sensitive to the presence of large metallic masses, but can not be relied upon for determining the exact position of the metallic mass. The still photographs thus acquired by the camera are stored internally for periods of days or weeks, until they are retrieved and examined manually.

Other devices include a rubber coated cable housing a piezoelectric detector along its length. This type of road sensor is commonly used in counting the number of vehicles traveling on the road. By its very construction, this sensor has a short life span, is prone to tempering by unauthorized individuals, and is inaccurate in determining time of event at a given point on the road since it tends to be dragged by the impacting wheel. Another existing road sensor is known as the magnetic loop. Here, changes in a current flowing in a conductor in the form of a loop that is caused by inductance are recorded and interpreted as indicating the approach of a metal body. This sensor is adequate for detection of a moving vehicle, but is inadequate for a precise measurement of location and time since the induced current is highly sensitive to the mass of the moving target. Moreover, it is very sensitive to electromagnetic radiation, such as that present near power lines.

Other passive sensors for detecting motion include an electronic setup involving a photoelectric cell, as the one mentioned above. This detector would be triggered by a passing body that causes a discontinuity in the collimated light signal, much like the systems employed by automatic doors. However, such detector that is not housed inside a robust enclosure, as in the present invention, will be unreliable, prone to weather hazards such as rain, wind, and dust, and also prone to tempering by vandals.

Other existing road sensors are of the active type and include laser and radar detectors. These sensors, again, are placed on the surface and may not be enclosed inside a protecting enclosure. Moreover, these sensors are imprecise and limited in their functionality to determining the speed of a passing vehicle, and usually require a human operator for recording the events.

To summarize, the situation on the highways everywhere in the developed world is grave and becoming even more so with the natural increase in standards of living. The current statistics for the state of Israel includes a traffic accident every 25 min, a fatal accident every 18.5 hrs, a pedestrian involved in an accident every 2 hrs, and human injury every 14 min. Clearly, the solution may be found in either a massive increase in law enforcement personnel, or by exploiting novel technological methods and means.

SUMMARY OF THE INVENTION

The present system and method provide an answer to many serious problems in the modern traffic theater, and help maintaining security in various small communities and institutions. The public interest rests in the safe conduct on roads and highways. Commercial interests include the continuous operation of toll highways, parking garages, and other restricted access localities. In the commercial segment, the problem is the cost of keeping supervisory personnel. The proposed system, based on a novel passive road sensor, provides an adequate answer to this problem. The system is also uniquely situated for monitoring traffic in small and/or remote villages, thereby answering an acute need to controlling access and fighting crime.

The present invention is directed to an accurate passive road sensor for computing kinematics of moving vehicles and method for sensing, recording, and automatically reporting traffic events and traffic-law violations. The sensor includes a detector, an enclosure for protecting the detector and enhancing the directionality of sensing, and a suitable opening in the road, possibly in the form of a suitable slit, in which the enclosure is placed. The road opening may further provide a small perturbation that could enhance the intensity of the effect generated by contact between the wheels of the passing vehicle and this sensor arrangement. Upon passage of a vehicle over this road sensor a perturbation is generated due to the impact with either the enclosure housing the detector, or the road opening in which the enclosure rests, or both. This perturbation in the form of a sound wave, a piezoelectric pulse, or a misaligned light beam is picked-up by the detector and transferred to a local processing unit, which is a suitable computer system, where the exact time of impact initiation is determined.

In the preferred embodiment, a passive sensor device is incorporated. A passive device does not require an active transmission of source signals fired at a target moving vehicle and returned for signal processing. Instead, a passive device reads certain forms of signals given directly by the vehicle (target) itself or broken by the vehicle. Therefore, passive sensor systems are preferred since they can be remotely managed. On the other hand, an active system, such as a radar gun, typically requires a signal to be engaged with a target vehicle and returned for processing to extract information embedded in the returned signal. Such a process often requires a high degree of accuracy and is difficult to maintain.

In a preferred embodiment the detector is a microphone. In this embodiment the opening in the road is in the form of a slit or groove, about 2 cm to 4 cm wide and about 3 cm deep, and it extends through almost the entire width of a given lane. If a road includes more than one lane in each traffic-flow direction, a separate sensor would be preferred for each lane in order to unambiguously identify the passing vehicle. For this reason, and in order to eliminate any cross-talk between adjacent sensors, the road opening in each lane falls short of a full extension through the lanes width. The difference between lane's width and the length of the opening is of the order of 5 cm.

In the preferred embodiment the enclosure housing the sensing microphone is a common metal pipe, about 0.5 cm to 2 cm in diameter, and whose length is equal to, or shorter than, the opening in the road (i.e., the lane's width). The pipe may be sealed on both ends to protect against penetration of water and dust particles. Alternatively, if so desired and if the microphone were intrinsically protected against moisture and dirt, the pipe may contain certain openings in the form of small holes to possibly enhance the recorded intensity of the sound generated by the impact. Preferably, the pipe is anchored inside the slit by suitable mechanical means. In addition, this entire setup may be covered by layers of mortar and/or asphalt. The pipe and layers of mortar and asphalt over it can fully fill the entire depth of the road opening, exceed this depth, in which case a small bump in the road will result, or fall short of a full coverage in which case a small depression in the road having sharp edges will result. In any of these cases, the pipe presents a unique resonance box that will provide a very sensitive listening device. When the front, or rear, wheels of a vehicle traverse over the sensor a unique sound is generated. In the preferred embodiment this sound wave is detected by a microphone, which continually monitors the sound inside the pipe enclosure, and is fed to the processing unit through a sampler. The processing unit determines which one of the possible multitude of sensors placed on the road, is involved in the particular event being recorded.

Impact can cause a sound wave to form by at least two different processes. First, the impact can generate a shock wave in the enclosure casing and in an air column inside the enclosure. In the preferred embodiment, the sound wave from the vibrating air column is detected by the microphone. Alternatively, vibrations in the casing of the enclosure, preferably made of a metal pipe in this embodiment, may be sensed directly by the body of the microphone, which is in direct contact with the casing. In either case, a sound wave is generated and detected having a well defined time pattern from which the exact impact initiation time can be deduced.

In another embodiment the detector is a photoelectric device arranged inside the enclosure for stability and protection against harsh road conditions. In this case, a collimated light beam is emitted at one end of the pipe and impinges on a photoelectric cell at the other end. This setup takes advantage of the fact that the solid enclosure will assure a straight communication line at all times when the system is at rest. In order to monitor impact, this embodiment is preferably implemented by having either the emitter or absorber rest on a hinge, a spring, or any other suitable arrangement. Then, upon the impact from the wheels of a moving vehicle, the shock wave causes the emitter, or absorber, to momentarily tilt or otherwise move off axis thereby interrupting the continuity of light detection, and thus triggering an electric pulse. This is recorded by the auxiliary circuitry and analyzed by the processing unit where the time of impact is determined.

In yet another embodiment of the present invention, the detector is made of a small element of a piezoelectric material which is tightly connected to the inside surface of the pipe. Here, again, the shock wave generated by the wheels' impact with the pipe and/or road opening, causes an electric pulse to be generated by the piezoelectric element. As described above, this pulse is then detected by the auxiliary circuitry and its temporal characteristics analyzed by the system which thus determines the exact time of impact.

As mentioned above, the enclosure housing the detector is preferably a metal pipe of appropriate diameter and length. It is further preferable to use galvanized iron pipes, which are highly durable under all weather conditions, and are robust enough to withstand all types of impacts expected on the highway. In addition, this kind of enclosure is well known and readily available, and hence will result in substantial savings in fabrication expenses, as compared with erecting, in situ, a concrete-type of enclosure. Although, the preferred pipe is of a smaller diameter than the width of the slit cut in the road, it may be advantageous to use a pipe of same or larger diameter to protrude the pipe above the road surface. In some situations such an embodiment can provide stronger sound waves or electric pulses.

In another embodiment, the sensor may be positioned on the side of a road without involving a road-embedded enclosure. Instead, a sound detector may be placed adjacent a narrow groove on the road and detect sound waves caused by a passing vehicle as the wheels of the vehicle impact the groove.

The sensor of the present invention includes accurate and reliable detectors, a robust, long-lasting, housing enclosure, and a unique road feature. The latter is aimed at both anchoring the sensor in place on the road, and enhancing the impact that leads to a precise determination of the time of the impact. Since the sensor of the present invention involves an anchored solid enclosure, the point of impact is known precisely and remains constant with time. The ability to determine both time and location very accurately is of utmost importance in using this sensor for the determination of such parameters as the speed of vehicles, their acceleration, distance between following vehicles, and the like, as will be explained in the detailed description of the invention below.

BRIEF DESCRIPTION OF THE DRAWINGS

The particular features and advantages of the invention will be apparent from the following more detailed description of the preferred embodiments of the invention, as illustrated in the accompanying drawings. The drawings are not necessarily to scale, emphasis instead being placed upon illustrating the principles of the invention.

DETAILED DESCRIPTION OF A PREFERRED EMBODIMENT

Figure 1A:
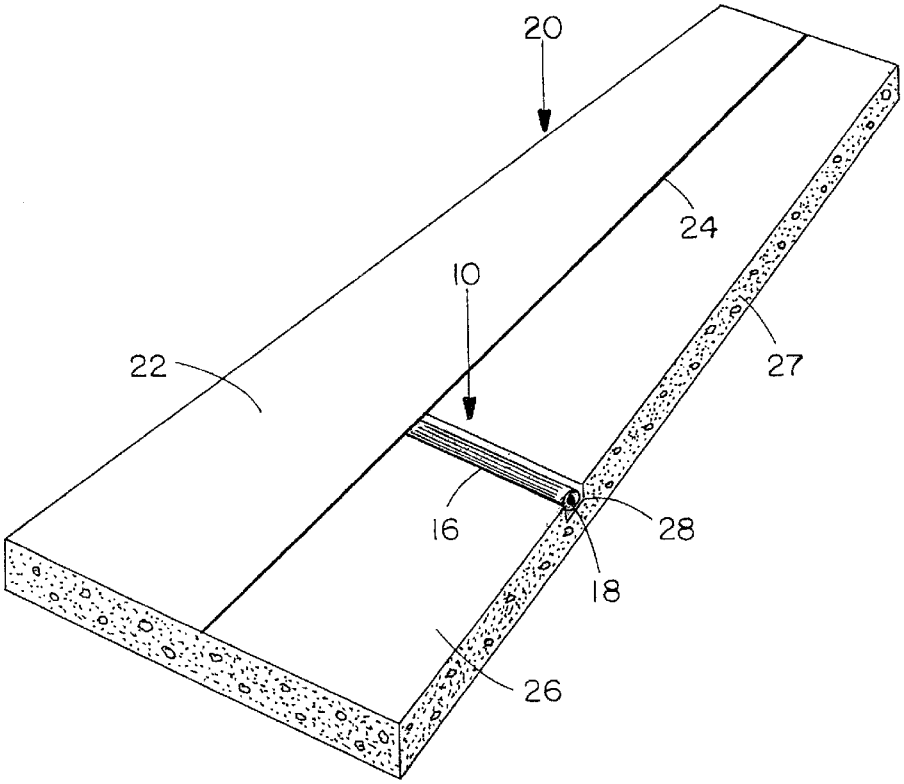
FIG. 1A is a schematic top oblique view of a segment of a road with the road sensor of the present invention embedded in one of its two lanes.
Figure 1B:
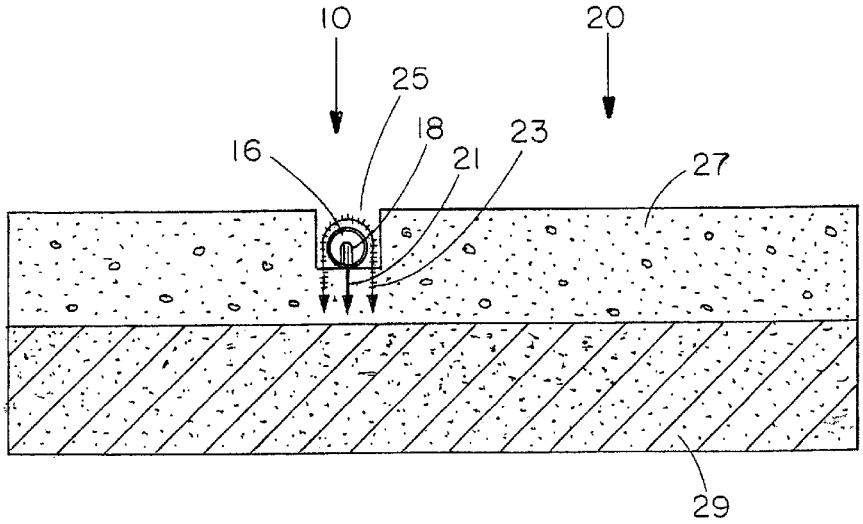
FIG. 1B is a schematic cross section of the road along its length depicting a schematic cross section of of the road sensor of the invention.

FIG. 1A is a schematic top oblique view of one embodiment of the road sensor 10 of the invention. The road 20 includes at least two opposing lanes, 22 and 26, separated by the solid divide line 24. The sensor 10 includes the enclosure 16 and detector 18, in addition to the road opening 28 in which they are placed. FIG. 1B is a cross sectional view of a preferred embodiment of the sensor configuration 10 in the road 20.

The opening in the road 28 is in the form of a slit or groove formed in the smooth road pavement 27 that rests on the road foundation 29. The foundation can be of any type common in road construction, and the pavement, likewise, can be made of concrete, asphalt, or any other suitable material. When concrete is poured to form the pavement, it is a common practice to limit the length of each poured segment in order to allow for thermal expansion. In such a case, a natural slit is left between segments of concrete, which results in a unique sharp sound upon the impact of the wheels of a moving vehicle. If concrete were the material of choice in forming the pavement, the road opening 28 can be designed to overlap with this separation between adjacent segments of concrete. In the embodiment of FIGS. 1A and 1B, the opening is erected anywhere in the pavement material. In the preferred embodiment of the present invention, the width of the road opening 28 can be within the range of 0.5 cm to 10 cm and is preferably within the range of 1 cm to 5 cm.

The enclosure 16 is embedded in the road opening 28, such that it is either level with the top surface of the pavement, protrudes upwards from it, or leaves a depression in the road. As is shown in FIG. 1B, in the preferred embodiment of the present invention a small depression 25 is left behind in the road after anchoring the enclosure in place, in order to maximize the impact of the sensor 10 with the wheels of a moving vehicle, thereby maximizing the strength of the signal that is picked up by detector 18 positioned inside enclosure 16. In order to anchor enclosure 16 inside the road opening, any one of several suitable materials, such as concrete, asphalt, resin, etc. can be used to fill road opening 28 around the enclosure. In the preferred embodiment of the present invention, additional anchoring is provided by element 23, which is a "U" shaped anchor forced over the enclosure 16 and into the pavement 27 in several positions along its length. Alternatively, the enclosure 16 can be fitted with nail elements 21 so that by applying mechanical force on the top side of the enclosure 16 the nails are inserted into the pavement to form a tight anchor.

In the preferred embodiment of the present invention, enclosure 16 is a suitable metal pipe, preferably an extruded galvanized iron pipe commonly used to carry city water. Preferably, the outer diameter of this pipe is smaller than the width of opening 28. Specifically, the outer diameter of the enclosure pipe 16 of the present invention can be within a range of 0.3 cm to 9 cm and is preferably within the range of 0.8 cm and 4 cm. The inner diameter of enclosure pipe 16 should be such that detector 18 can be inserted and placed comfortably, while maintaining adequate strength against pressure exerted by heavy vehicles moving on the road. In the preferred embodiment of the present invention the inner diameter can be within the range of 0.2 cm to 8 cm and is preferably within the range of 0.5 cm to 3 cm.

The detector 18 of the present invention can be of any type that is sensitive to mechanical impact, as that experienced by enclosure 16 in opening 28 upon coming in contact with the wheels of a moving vehicle. Specifically, detector 18 can be chosen among the group of various passive sensor devices such as microphones, photocells, piezoelectric elements, and combinations of electromagnetic transmitters and receivers. In the preferred embodiment, a passive sensor device is incorporated. A passive device does not require an active transmission of source signals fired at a target moving vehicle and returned for signal processing. Instead, a passive device reads certain forms of signals given directly by the vehicle (target) itself or broken by the vehicle. Therefore, passive sensor systems are preferred since they can be remotely managed. On the other hand, an active system, such as a radar gun, typically requires a signal to be engaged with a target vehicle and returned for processing to extract information embedded in the returned signal. Such a process often requires a high degree of accuracy and is difficult to maintain.

Although detector 18 may be positioned on the side of the road adjacent to the road opening 28, it is preferably positioned inside enclosure 16 for a long-time protection against harsh road conditions, to ensure accurate alignment necessary for certain types of detectors such as those based on photocells, and to assure a high signal-to-noise ratio for an accurate and reliable operation. Enclosure 16 is equipped with two stoppers, or similar fittings, applied at its two ends in order to assure a tightly close system.

Detectors based on a photocell as the sensing element employ a collimated light source at one end of enclosure 16 and a photocell at the opposite end. Either one, or both, can be fitted on a hinge such that a suitable mechanical impact will force either or both elements of detector 18 to tilt of off the main longitudinal axis of enclosure 16, thereby causing a signal to be triggered in an auxiliary electronic circuit that monitors the current through the photocell. The time of this signal is recorded by the processor unit that controls the operation of the sensor system as the time of contact between the moving vehicle and the site of the sensor.

A detector 18 that is based on a piezoelectric device depends on the well known physical phenomena of converting mechanical energy into electrical energy. Thus, the firing of an electric signal is realized as a result of the impact with the sensor and the time of this event is, again, recorded by the processor unit.

In one preferred embodiment of the present invention the detector 18 is a suitable microphone chosen among a multitude of available microphones that differ in physical size, sensitivity, directionality, construction, and principle of operation. The microphone detector 18 is in a continually listening mode, and is in continuous communication with the processor unit. When impact with opening 28 occurs, a sound wave is generated and detected by the microphone. This sound wave is recorded by the processor unit and analyzed to determine the exact onset of impact, thereby determining the exact time at which the vehicle's wheels crossed the known position of sensor 10. As shall be explained in detail in what follows, this exact time record will then be used to determine compliance of the moving vehicle with various traffic laws and regulations.

Although in the preferred embodiment of the present invention enclosure 16 is tightly sealed to provide full protection for detector 18, in certain situations, it may be advantageous to fit enclosure 16 with small openings, or holes, along its entire length to enhance sound detection by detector microphone 18. In such a case, the microphone detector 18 will be protected by a suitable plastic cover inside enclosure 16.

Figure 2:
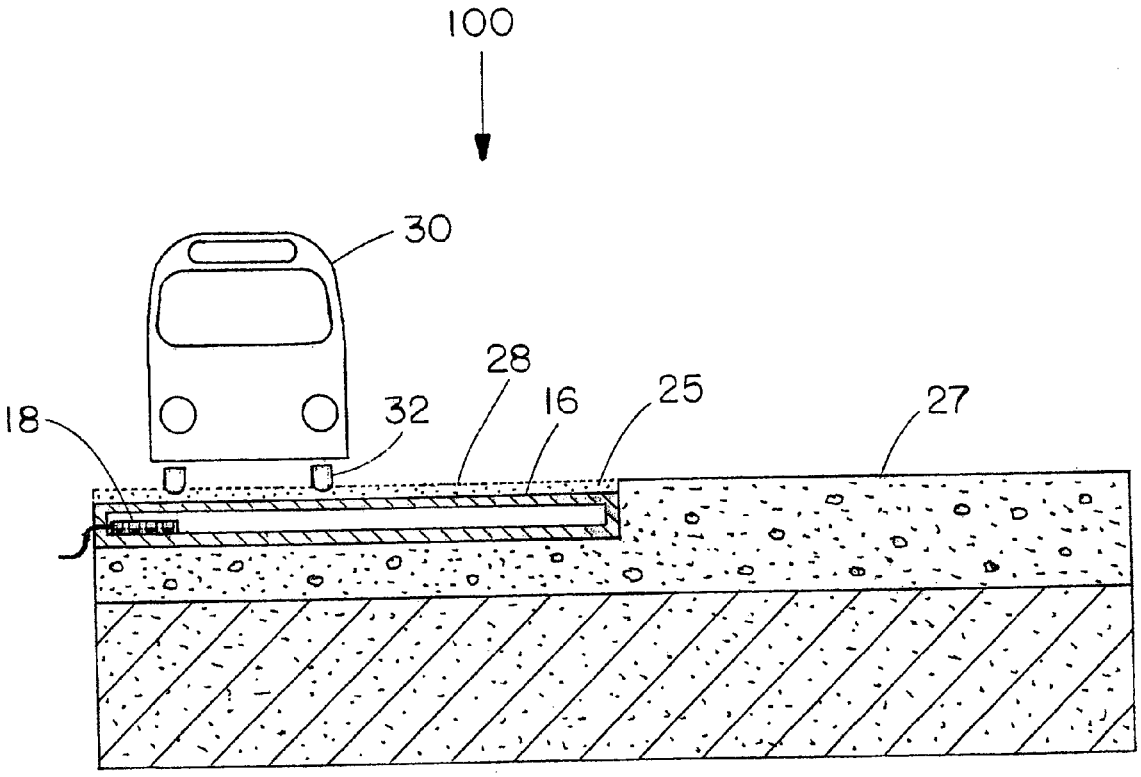
FIG. 2 is a schematic cross section of the road along its width at the position of one embodiment of the road sensor of the invention.

FIG. 2 is a schematic cross sectional diagram of the preferred embodiment 100 of the present invention, along the width of road 20 at the center of sensor 10. Road depression 25 is left in road opening 28 after placement of enclosure 16. Wheels 32 of moving vehicle 30 are seen entering depression 25 just prior to impacting with enclosure 16. Road depression 25 is typically of the same width and length as that of road opening 28. The depth of road depression 25 can be within the range of 0.2 cm to 5 cm and is preferably within the range of 0.5 cm to 2 cm. Such a value for the depth of the road depression 25 is adequate for securing a meaningful impact without causing an undue annoying disturbance to the moving vehicle. Microphone detector 18 of the preferred embodiment is seen inside enclosure 16. Microphone detector 18 may be positioned anywhere inside enclosure 16, but is preferably situated at the center of enclosure 16.

Figure 3A:
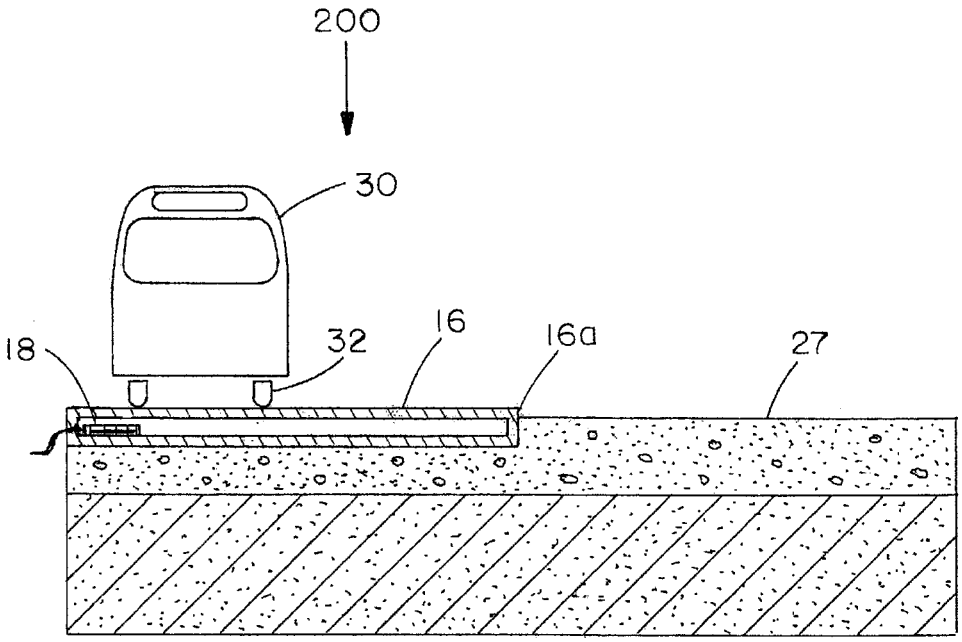
FIGS. 3A and 3B are schematic cross sections of alternative preferred embodiments of the road sensor.
Figure 3B:
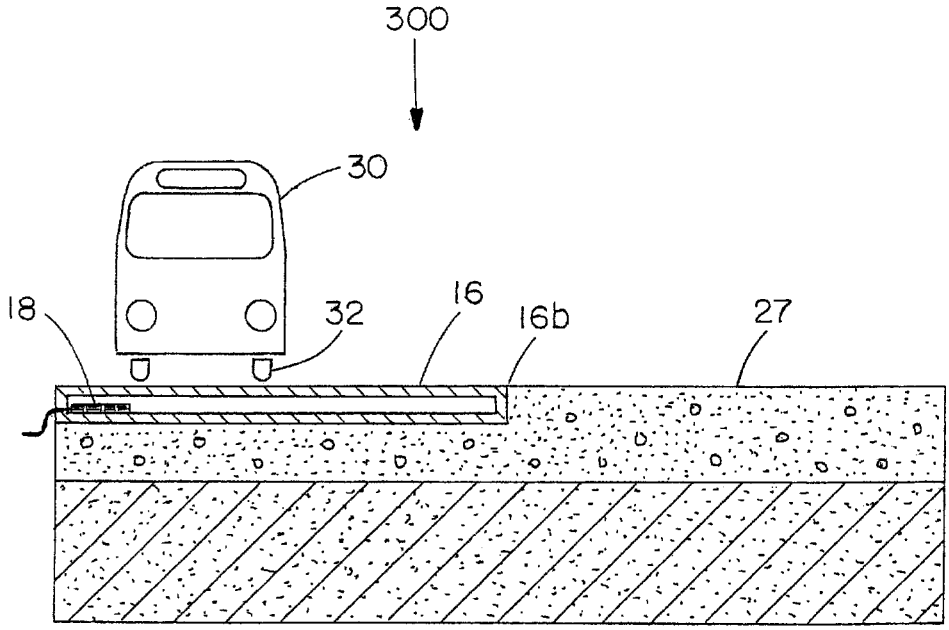

FIGS. 3A and 3B are schematic cross sectional diagrams of alternative embodiments 200 and 300, respectively, of the passive road sensor of the present invention. In the embodiment 200 illustrated in FIG. 3A, in similar fashion to the previously described embodiment, the depth of road opening 28 is of a lesser value than the diameter of enclosure 16 resulting in a protrusion 16*a* of enclosure 16, having a certain height above the flat surface of pavement 27. The height of protrusion 16*a* above pavement 27 can be roughly within the range of 0.2 cm to 5 cm and is preferably within the range of 0.5 cm and 2 cm. Wheels 32 of vehicle 30 must impact with protrusion 16*a* upon crossing sensor 10, thereby actuating detector 18. In the preferred embodiment of the present invention detector 18 is a microphone, and the impact of wheels 32 with protrusion 16*a* results in a sound wave whose time characteristics are recorded and analyzed by the auxiliary processor of the integrated system of the present invention.

In the alternative embodiment 300 illustrated in FIG. 3B, the depth of road opening 28 is equal to the diameter of enclosure 16 so that a flat surface 16*b* results in the location of sensor 10 after filling the voids with the anchor material, as described above. Surface 16*b* is level with the top surface of pavement 27.

In the preferred embodiment of the present invention detector microphone 18 records the amplitude of the sound vibrations created in pavement 27 by the approaching vehicle 30. The amplitude reaches a maximum when wheels 32 are exactly over detector 18, thus enabling a precise identification of the time when wheels 32 traversed sensor 10.

Figure 4A:
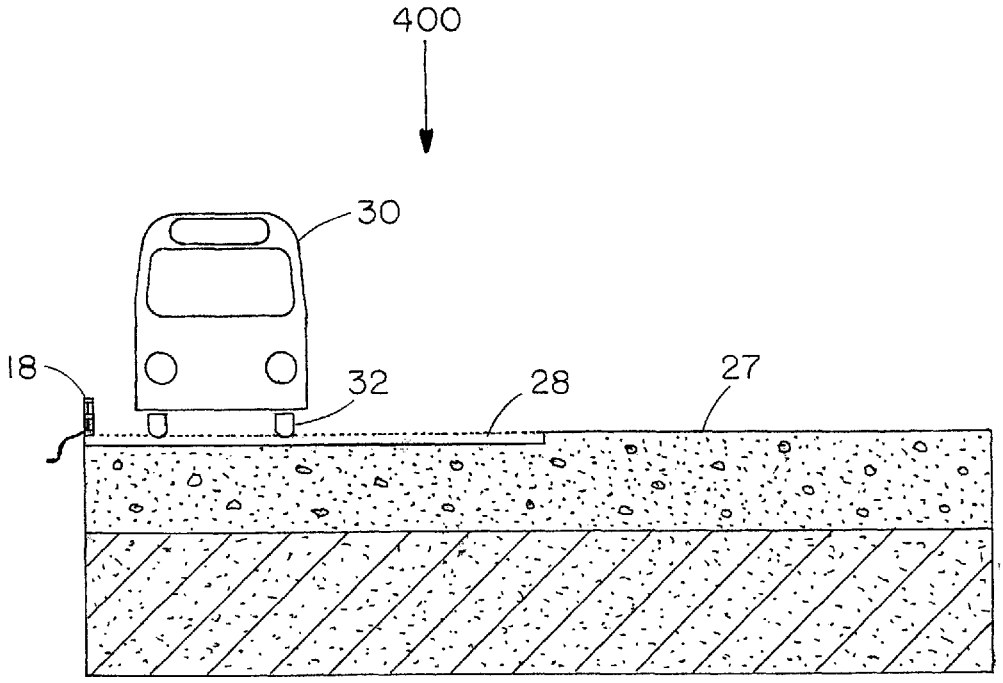
FIGS. 4A and 4B are schematic cross sections of alternative embodiments of the road sensor.
Figure 4B:
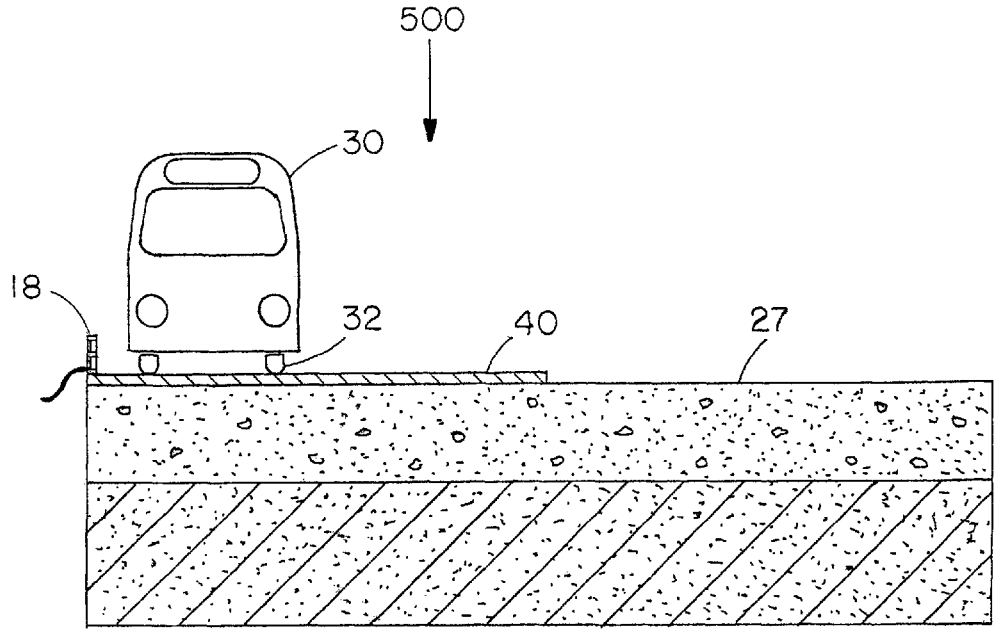

FIGS. 4A and 4B are schematic cross sections of alternative embodiments 400 and 500 of the passive road sensor 10 of FIGS. 1A and 1B. Common to both configurations is the absence of enclosure 16 of the preferred embodiment of FIGS. 1A and 1B. In these alternative embodiments detector 18 is placed at the side of the road 20 close to the surface of pavement 27. In the embodiment 400 of FIG. 4A road opening 28 is a relatively shallow slit, or groove, whose depth can be within the range of 0 cm to 5 cm and is preferably within the range of 0 cm and 2 cm. A physical groove in road 20 is needed for a sound detector 18 such as a microphone, which depends for its operation on the creation of a distinct sound signal, such as that produced upon the impact of wheels 32 with groove 28.

In the alternative embodiment 500 of FIG. 4B, in similar fashion to the previously described embodiment, detector 18 is placed on the side of road 20 adjacent to the surface of pavement 27. At the position of detector 18 a shallow and narrow road obstacle 40 is placed across the road's or lane's width. Obstacle 40 may be in the form of a small road bump whose height can be within the range of 1 cm to 10 cm and is preferably within the range of 1 cm and 3 cm. The width of obstacle 40 can be within the range of 1 cm to 20 cm and is preferably within the range of 1 cm and 5 cm. Alternatively, road obstacle 40 is a solid line of an arbitrary cross section made of metal, rubber, or any other suitable material. Preferably, obstacle 40 is of a round cross section and is in the form of a cable or rope whose diameter can be within the range of 0.5 cm to 5 cm and is preferably within the range of 0.5 cm and 2 cm. In such a case the cable or rope 40 can be anchored in place by elements such as anchor 23 in FIG. 1B.

Figure 5:
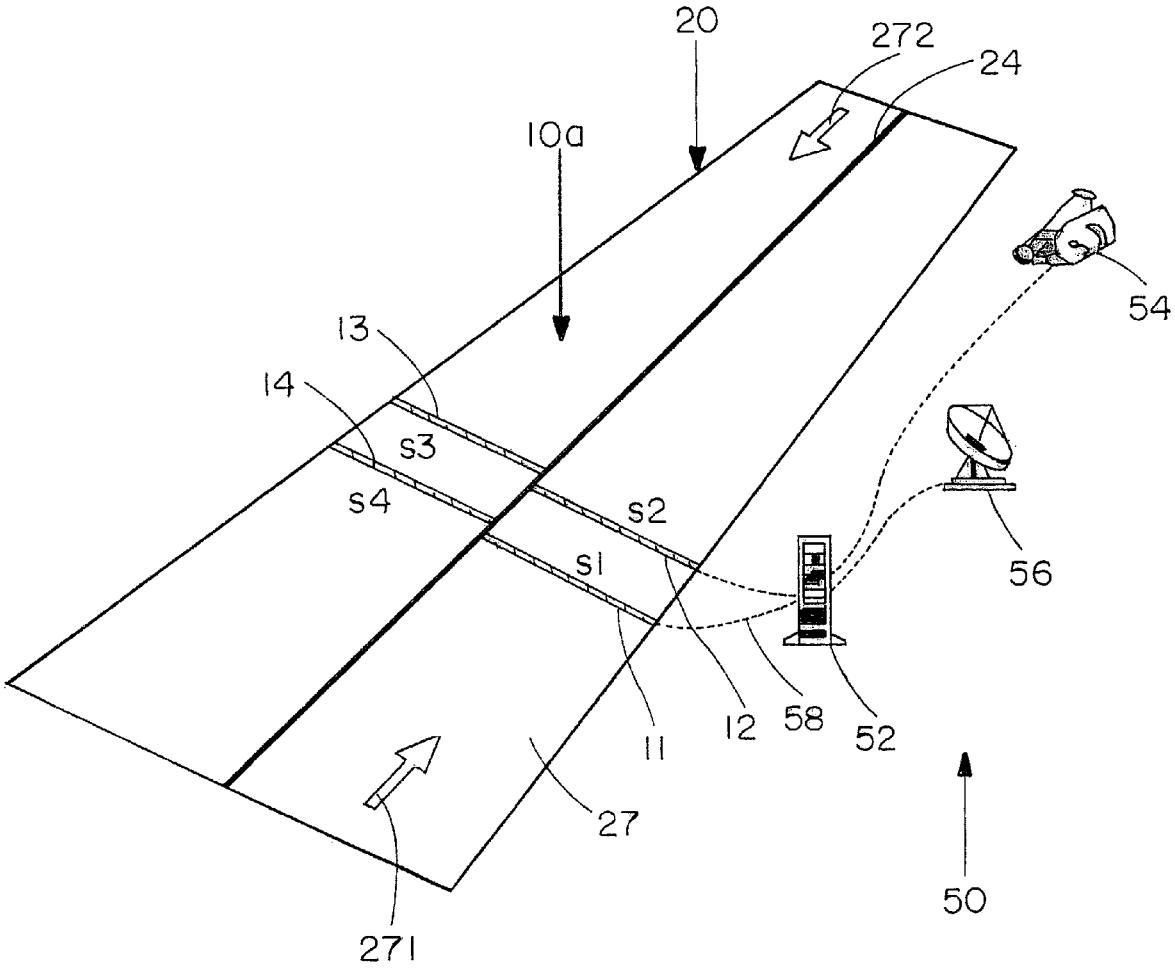
FIG. 5 is a schematic top oblique view of a preferred embodiment of an integrated traffic law enforcement system aimed at monitoring vehicle's velocity and unlawful overtaking at a solid divide line.

FIG. 5 is a top oblique view of road segment 20 together with automatic traffic monitoring system 50 that is integrated with sensor system 10*a*. Road segment 20 includes at least one lane in each traffic direction illustrated by arrows 271 and 272. Solid divide line 24 separates traffic directions 271 and 272. Monitoring system 50 includes processor unit 52, video camera 54, communication unit 56, and interwiring system 58. The sensing system layout 10*a* includes sensors s1 and s2 in traffic direction 271 identified by reference numeral 11 and 12, respectively, and sensors s3 and s4 in traffic direction 272 identified by reference numerals 13 and 14, respectively.

The integrated traffic monitoring system of FIG. 5 can be used to monitor such parameters as vehicle's speed, distance between following vehicles, and unlawful crossing of the solid divide line 24.

The distance between sensors 11 and 12, and sensors 13 and 14, is accurately known. In the preferred embodiment of the present invention this distance is of the order of a typical car's length, so as to eliminate any possibility that sensors 11 and 12 belonging to one particular lane will be activated by two different vehicles. Specifically, the distance between sensors 11 and 12 of the present invention can be within the range of 10 cm to 500 cm and is preferably within the range of 50 cm and 200 cm. Similarly, the distance between sensors 13 and 14 of the present invention can be within the range of 10 cm to 500 cm and is preferably within the range of 50 cm and 200 cm.

When a vehicle travels on road 20 along traffic direction 271 its front wheels first contact sensor 11 and then sensor 12. Upon the impact with sensor 11 a signal is recorded by processor unit 52 and analyzed to determine the impact time, t1. When the front wheels of the vehicle impact, next, with sensor 12 impact time, t2, is similarly determined. Processor unit then determines the vehicles velocity by dividing the known distance between sensors 11 and 12 by the time difference, t2−t1. Similarly, the system determines the precise times at which the rear wheels pass over sensors 11 and 12 and uses these data to calculate the acceleration, if any.

Figure 6A:
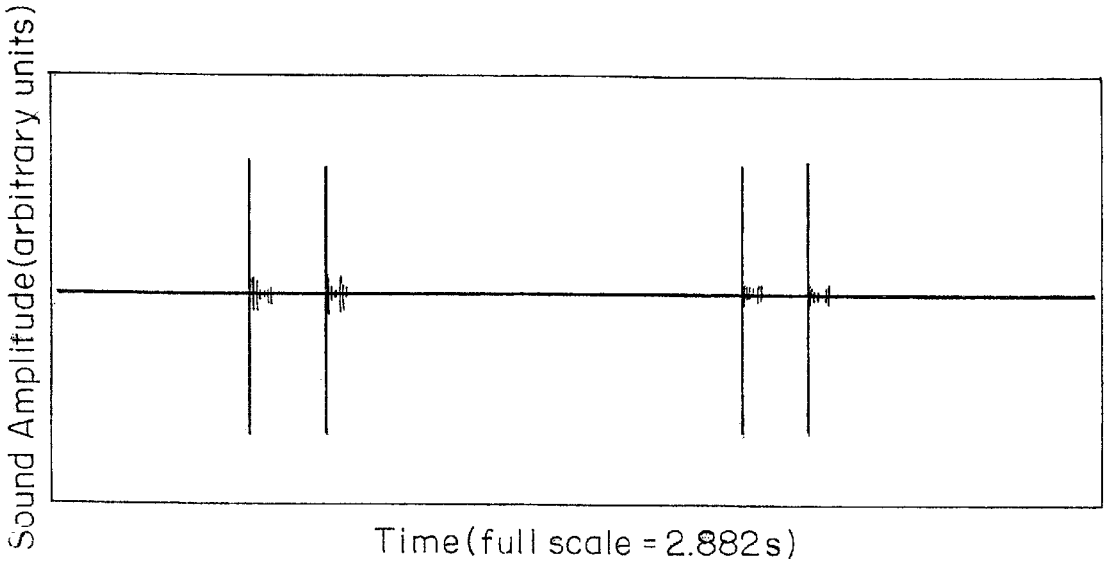
FIGS. 6A and 6B are illustrations of typical results recorded by a sound detector.
Figure 6B:
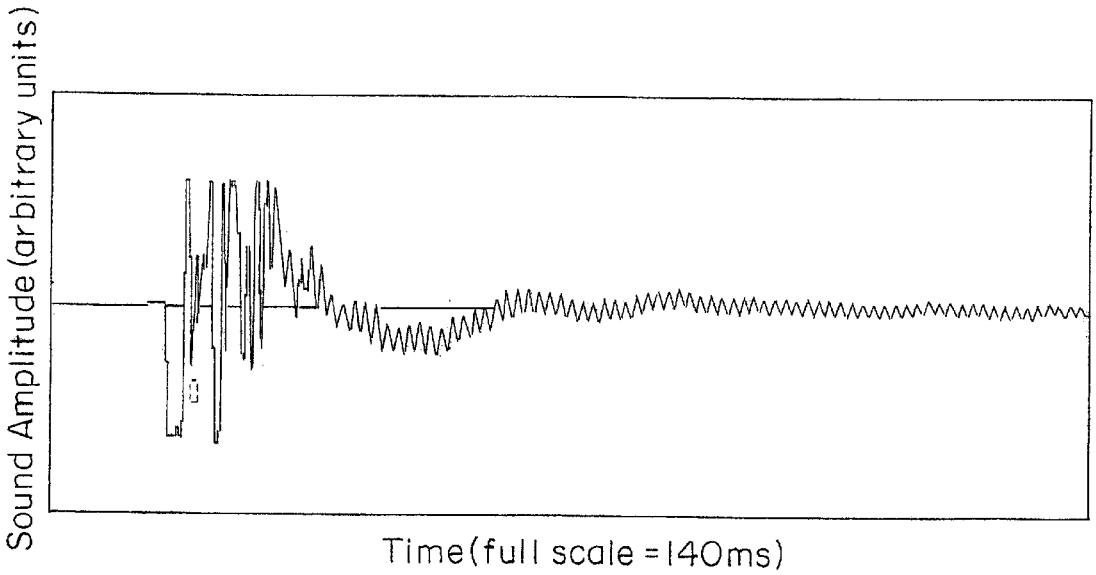

FIGS. 6A and 6B are illustration depicting actual data recorded by microphone detector 18 of the preferred embodiment in FIG. 1A. FIG. 6A shows two pairs of signals resulting from two independent events where the amplitude of the sound wave is plotted as a function of the elapsed time. The total time scale is 2.882 seconds. FIG. 6B depicts a typical result of magnifying one of the four recorded events in FIG. 6A. Here the third sound wave from left in FIG. 6A is shown. The onset of the sound wave, resulting from an impact, is seen to be very sharp allowing a highly precise determination of this time parameter. The time resolution is better than $1/10{,}000$th of one second. Typically, the time interval described above, t2−t1, for a vehicle moving at a normal highway speed is of the order of $1/10$th of one second.

The processor unit uses data on vehicles velocity and the time interval that elapses between two consecutive events to also determine the distance between following vehicles. The results regarding the velocity and distance between vehicles are then compared to allowable values. If any one parameter is in variance with the allowed value, the processor grabs the relevant frame from the video camera 54 of FIG. 5, which is turned continuously on. The image of the front or rear of the vehicle is then analyzed using a suitable algorithm aimed at extracting the license plate registration number. A file containing the data on time, location, nature of traffic law violation and relevant parameters, registration number, and the image of the vehicle is then prepared and transmitted via communication device 56 in FIG. 5 to a central processing and control unit where vehicle ownership is determined and citations issued.

Sensor layout 10*a* in FIG. 5 in conjunction with monitoring system 50 can be used, in addition, to monitor illegal crossing of a solid divide line. As described above, a vehicle moving along direction 271 first encounters sensor 11 and then sensor 12. Processor unit records this order of events. If, however, it first records an encounter with sensor 12 along direction 271 and only thereafter with sensor 11 it interprets the reversed sequence of events as a case of motion in the wrong direction and the process of event recording and reporting is repeated as described in the previous case. Clearly, in order to monitor a longer segment of road 20 against illegal crossing of the solid divide line, a multitude of sensors can be embedded along the chosen segment so as to assure that any such attempt will be duly recorded. Moreover, these additional sensors can be designed to be shorter than the width of the lane, so as to allow for an occasional, unintended, drift of a vehicle to the opposite direction.

For example, consider a vehicle moving at a speed of 90 Km/hr (about 55 miles/hr) and being overtaken by a second vehicle moving at the speed of 110 Km/hr (about 70 miles/hr). Assume that the second vehicle first approaches the first one to within 20 m before starting to overtake it, and immediately returns to the right lane upon completing the process, such that the distance between the two vehicles is, again, 20 m. With these parameters the time required to complete the overtaking process is of the order of 8 seconds. Allowing for extra acceleration time, the overall time is about 10 seconds. This then leads to a typical "overtaking length" equal to 300 m (roughly a fifth of a mile). Such a road span can be comfortably monitored by dividing it to four equal segments using three passive road sensors of the invention in each lane. This arrangement will assure that nearly no vehicle will be able to avoid being detected if moving against the allowed traffic direction.

Figure 7:
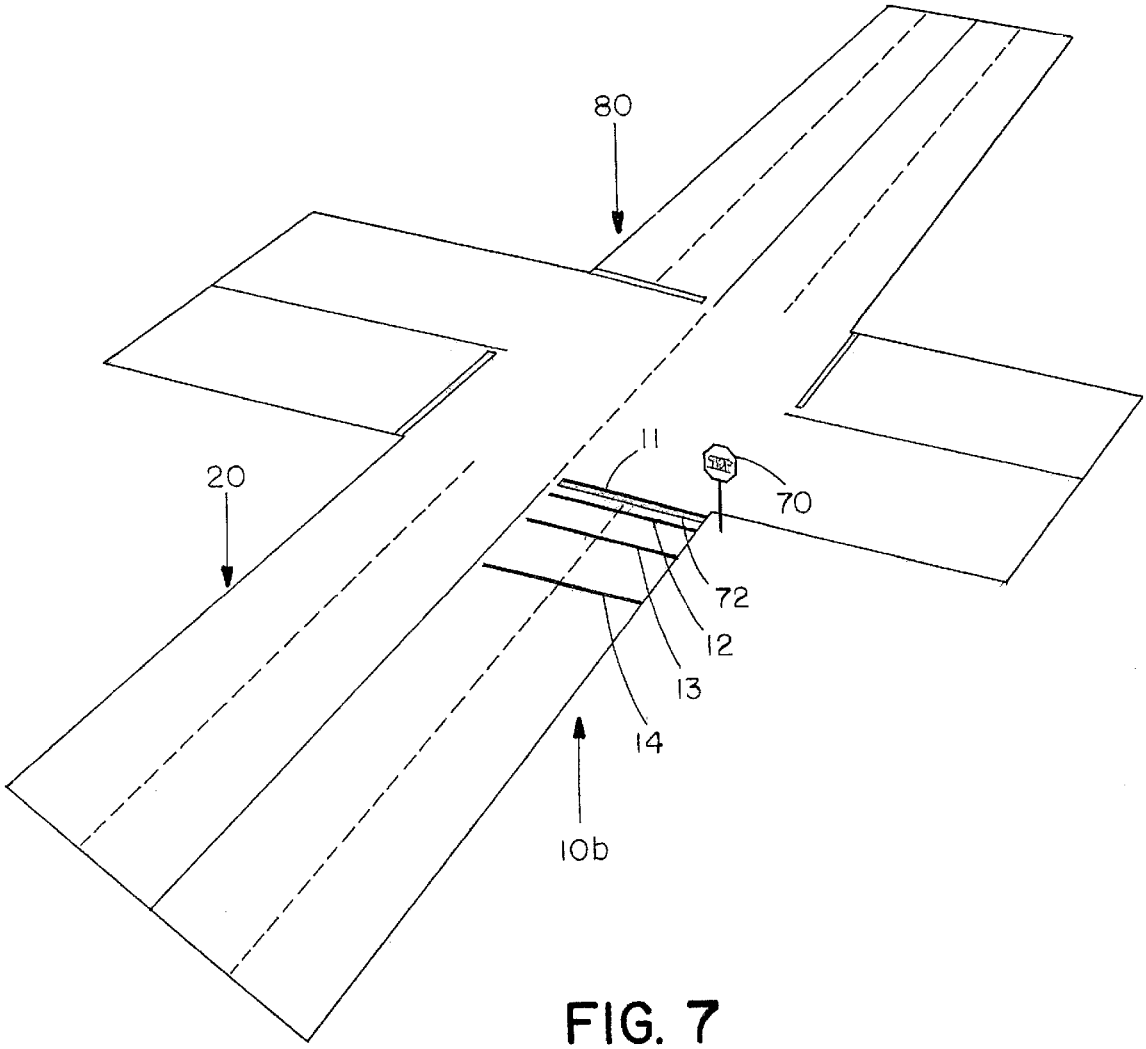
FIG. 7 is a schematic top oblique view of another embodiment of an integrated traffic law enforcement system aimed at monitoring obedience to a stop sign. In this illustration, only one of the four possible stop signs is highlighted.

FIG. 7 is a top oblique view of road intersection 80 with stop signs in all directions (only one is shown in diagram). Road 20 is equipped with sensor system 10*b*, stop sign 70 and stop mark line 72.

When a vehicle approaches the stop sign traveling on the right lane it first encounters sensor 14 and then, sequentially, sensors 13, 12 and finally 11. The distance between each two consecutive sensors becomes shorter towards the stop sign. The vehicle is required to come to a complete stop at the mark line 72 before proceeding. Sensors 14, 13, and 12 are used to determine the deceleration rate of the vehicle. This is then used to calculate the time needed for the vehicle to traverse the distance between sensors 12 and 11 if it were to ignore the stop sign. The system then expects that the vehicle will stay between sensors 12 and 11, i.e., at mark line 72 for a period of time that exceeds the value of this calculation by some prescribed value. If this condition is not met, the event recording process described above for velocity violation is initiated.

While this invention has been particularly shown and described with references to preferred embodiments thereof, it will be understood by those skilled in the art that various changes in form and details may be made therein without departing from the spirit and scope of the invention as defined by the appended claims.

For example, the various embodiments of the integrated law enforcement system described above include different layouts and arrangements of the sensing elements used to determine various types of traffic law violations. It will be understood that other types of sensor layouts are possible for these and other similar applications. Also, the preferred embodiment of passive road sensor 10 in FIG. 1A was described with reference to a microphone as the sound sensitive device. It will be understood that other devices, and combinations thereof, that are sensitive to the energy released in a mechanical impact can be used in detecting and measuring the exact impact time.

What is claimed is:

1. An integrated automatic system for monitoring traffic flow and adherence to traffic laws and regulations comprising:

a passive road sensor for detecting a vehicle traveling on a road by generating and detecting a vibration caused by impact of wheels of the vehicle with a rigid member extending across a traffic lane, wherein the passive road sensor comprises a detector which provides a signal dominated by said vibration and an enclosure for housing the detector, the enclosure forming the rigid member and being positioned such that the enclosure remains exposed within an opening in the road which essentially spans the entire width of the traffic lane; and an integrated event recording and reporting system in direct communication with the passive road sensor comprising a processing unit, a video camera and a communication module, the processor unit to engage the video camera to capture an image of the passing vehicle in response to the vibration signal and to communicate data corresponding to the image to a separate control unit by means of the communication module.

2. The integrated automatic system of claim 1 wherein the opening has a width in the range of 0.1 to 10 centimeters and depth in the range of 0.1 to 10 centimeters.

3. The integrated automatic system of claim 1 wherein the enclosure is positioned fully within the opening.

4. The integrated automatic system of claim 1 wherein the enclosure is positioned partially within the opening.

5. The integrated automatic system of claim 1 wherein the enclosure is cylindrical having an outer diameter in the range of 0.3 to 9 centimeters and an inner diameter in the range of 0.2 to 8 centimeters.

6. The automatic system of claim 1 wherein the passive road sensor comprises a sound detector for detecting said vibration.

7. The integrated automatic system of claim 6 wherein the sound detector is a microphone.

8. The integrated automatic system of claim 1 wherein the passive road sensor comprises a photoelectric cell detector for detecting said vibration.

9. The integrated automatic system of claim 1 wherein the passive road sensor comprises a piezoelectric detector for detecting said vibration.

10. The integrated automatic system of claim 1 wherein the passive road sensor comprises an electromagnetic detector for detecting said vibration.

11. The integrated automatic system of claim 1 wherein the passive road sensor comprises a surface wave detector for detecting said vibration.

12. The integrated automatic system of claim 1 wherein the passive road sensor comprises a metal enclosure.

13. The integrated automatic system of claim 12 wherein the metal enclosure is a cylindrical metal housing water pipe.

14. The integrated automatic system of claim 1 wherein the vibration creates a shock wave which is detected.

15. An automatic system for monitoring traffic flow comprising:

a passive road sensor for determining kinematics of a vehicle comprising:

a sound detector for detecting sound waves caused by an impact of wheels of the vehicle with the sensor;

a resonant, rigid elongated enclosure extending across a traffic lane with the sound detector contained therein and causing the sound waves to resonate throughout its air column so as to assure that the sound waves are picked up by the sound detector any time the wheels of the vehicle impact any portion of the enclosure; and a transmitter for transmitting signals from the sound detector said signals corresponding to the sound waves; and a remote processing system for receiving the signals from the transmitter and processing the signals to determine the kinematics of the vehicle.

16. A system as claimed in claim 15 wherein the sound detector is a microphone.

17. A system as claimed in claim 15 wherein the enclosure is a metal pipe and is anchored fully within in a slot of a road perpendicular to the road.

18. A system as claimed in claim 15 further comprising a video monitoring system, including a video camera directed to the road sensor, in continuous communication with the remote system for capturing video images of vehicles passing over the road sensor.

* * * * *

UNITED STATES PATENT AND TRADEMARK OFFICE

CERTIFICATE OF CORRECTION

PATENT NO. : 6,075,466
DATED : June 13, 2000
INVENTOR(S) : Simon S. Cohen and Oded Kafri It is certified that error appears in the above-identified patent and that said Letters Patent is hereby corrected as shown below:

In Claim 13, column 11, lines 10-11, delete "water pipe".

Signed and Sealed this

First Day of May, 2001

*Attest:*

Nicholas P. Godici

NICHOLAS P. GODICI

*Attesting Officer*

*Acting Director of the United States Patent and Trademark Office*